US008130149B2

(12) United States Patent
Tabakovic

(10) Patent No.: US 8,130,149 B2
(45) Date of Patent: Mar. 6, 2012

(54) WIDEBAND STRIP FED PATCH ANTENNA

(75) Inventor: Haris Tabakovic, Syracuse, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 335 days.

(21) Appl. No.: 12/258,090

(22) Filed: Oct. 24, 2008

(65) Prior Publication Data

US 2010/0103049 A1 Apr. 29, 2010

(51) Int. Cl.
*H01Q 1/38* (2006.01)

(52) U.S. Cl. ..... 343/700 MS; 343/830

(58) Field of Classification Search ..... 343/700 MS, 343/850

See application file for complete search history.

(56) References Cited

U.S. PATENT DOCUMENTS

| | | | | |
|---|---|---|---|---|
| 2,615,005 | A * | 10/1952 | White | 343/817 |
| 5,001,492 | A * | 3/1991 | Shapiro et al. | 343/700 MS |
| 5,270,722 | A | 12/1993 | Delestre | |
| 5,444,453 | A * | 8/1995 | Lalezari | 343/700 MS |
| 5,745,079 | A | 4/1998 | Wang et al. | |
| 5,880,694 | A * | 3/1999 | Wang et al. | 343/700 MS |
| 6,717,549 | B2 | 4/2004 | Rawnick et al. | |
| 6,844,852 | B1 * | 1/2005 | Simons | 343/700 MS |
| 7,084,815 | B2 * | 8/2006 | Phillips et al. | 343/700 MS |
| 7,403,159 | B2 | 7/2008 | Gooshchin | |
| 7,446,712 | B2 * | 11/2008 | Itoh et al. | 343/700 MS |
| 7,468,699 | B2 * | 12/2008 | Manholm et al. | 343/700 MS |
| 7,619,568 | B2 * | 11/2009 | Gillette | 343/700 MS |
| 7,623,073 | B2 * | 11/2009 | Teshirogi et al. | 343/700 MS |
| 7,667,650 | B2 * | 2/2010 | Tiezzi et al. | 343/700 MS |
| 2003/0201937 | A1 | 10/2003 | Lee | |
| 2007/0290939 | A1 | 12/2007 | Teshirogi et al. | |
| 2008/0169992 | A1 * | 7/2008 | Ortiz et al. | 343/767 |
| 2008/0238793 | A1 | 10/2008 | Channabasappa | |
| 2009/0051598 | A1 * | 2/2009 | McCarrick et al. | 343/700 MS |
| 2009/0128413 | A1 * | 5/2009 | Crouch et al. | 343/700 MS |

OTHER PUBLICATIONS

International Search Report dated Dec. 22, 2009 for related application PCT/US2009/061835.

* cited by examiner

*Primary Examiner* — Trinh Dinh
(74) *Attorney, Agent, or Firm* — Howard IP Law Group

(57) ABSTRACT

A microstrip patch antenna comprises a patch antenna element comprising a first conductive layer; dual probe feeds separate from each other and spaced from and field coupled to the patch antenna element for transmitting or receiving RF signals, each of the dual probe feeds having a conductor segment and a deltoid shaped conductive strip orthogonal to the conductor segment; the deltoid shaped conductive strips being coplanar; and a first dielectric material layer separating the first conductive layer and the coplanar deltoid shaped conductive strips.

29 Claims, 12 Drawing Sheets

WIDEBAND STRIP FED PATCH ANTENNA

FIELD OF THE INVENTION

The present invention relates to the field of antennas such as those used in phased array radar applications.

BACKGROUND OF THE INVENTION

Patch microstrip antennas are small, low-profile, low radar cross-section (RCS) and lightweight radiators ideal for phased array applications. In addition, a microstrip patch antenna is relatively inexpensive and easily manufactured, rugged, readily conformable to mount to an irregular shape, having a broad reception pattern, and can be adapted to receive multiple frequencies through proper configuration of the patches. Patch antenna radiating elements utilized for radar antenna arrays are inherently limited in bandwidth, scan angle and cross polarization. For example, a simple back-fed patch typically has a bandwidth of about 3% to about 7% of the operating center frequency. In addition to bandwidth limitations, a patch design must take into consideration several trade-offs that affect size, weight, the effects of cross polarization, excitation of surface waves and current density, sensitivity and transmission and reception angle, and power.

Patch antennas are cavity radiators where the excitation voltages are fed through the back of the substrate. As such, patch antennas have dominant electrical properties of capacitance and depending on the electrical attachments, degrees of inductance. These properties, among other things, affect the bandwidth. For a conventional patch antenna design the bandwidth may be derived according to the following:

Equation 1

$$bandwidh \propto \frac{h}{\lambda_0 \cdot \sqrt{\varepsilon_r}} \cdot \sqrt{\frac{W}{L}}$$

Where h is the substrate thickness or height, $\lambda_O$ is the design wavelength, $\epsilon_r$ is the relative permittivity of the substrate and W and L are the width and length of the patch, respectively.

For example, from Equation 1 if $\epsilon_r=1$, then the patch tends towards a wider bandwidth in free space and a further increase in permittivity (e.g., $\epsilon r>1$) allows the substrate to be reduced in all dimensions. However, increasing permittivity may in turn excite surface waves that contribute to scan blindness. Therefore, the permittivity of the substrate is a factor in determining antenna bandwidth and dimensions while also minimizing the possibility of surface wave excitation.

Increasing the thickness of the substrate also tends to increase the antenna bandwidth. Reducing the dielectric constant of the patch also increases bandwidth, but generally requires an increase in the thickness of the patch.

Increasing the dielectric substrate height for a back-fed patch antenna can increase operational bandwidth up to 25%, but will also disadvantageously increase the size of the antenna. Such approach is limited by increasing inductance of the feed probe, which limits the substrate thickness and possible bandwidth increase.

Hence, using a single capacitively coupled feed probe (in lieu of a conventional back fed probe) in conjunction with increased substrate dielectric height can yield operational bandwidths of about 25% while rectifying increasing probe inductance. Capacitive feeds tend to allow production of wide band patch antennas that counteract probe inductance. However, these antennas tend to be extremely sensitive to probe dimensions and position. Furthermore, cross polarized radiation remains a problem. Patches for a dominant mode exciting the current flow on the surface may cause a high cross polarization, with a maximum occurring at about 45° from bore sight. Using a dual probe feed 180° out-of-phase tends to reduce the high cross-polarization, but does not improve the operational bandwidth.

Alternative designs are desired.

SUMMARY OF THE INVENTION

The present invention relates to a microstrip patch antenna comprising first and second conductive elements separated by a dielectric material substrate, wherein the first element is capable of transmitting or receiving RF signals and the second conductive element includes a pair of associated conductive strips, each shaped and situated to oppose corresponding electric fields. In one embodiment the strips are deltoid shaped segments.

The strips are electrically excited 180 degrees out-of-phase to reduce cross-polarized radiation. By manipulating the associated strip and an associated electrical connector inductance and capacitance, the electric fields are favorably disposed to achieve wideband antenna operation. This bandwidth can be improved further when dielectric loading is added to the portion between the strip and the first conductive element.

The present invention provides for a flexible, bendable, lightweight microstrip patch antenna with wide operational bandwidth (>20%) and low cross-polarized radiation (<−20 dB) capable of operating in single or dual linear and/or single or dual circular polarization mode.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is in no way intended to limit the invention, its applications, or uses.

Figure 1A:
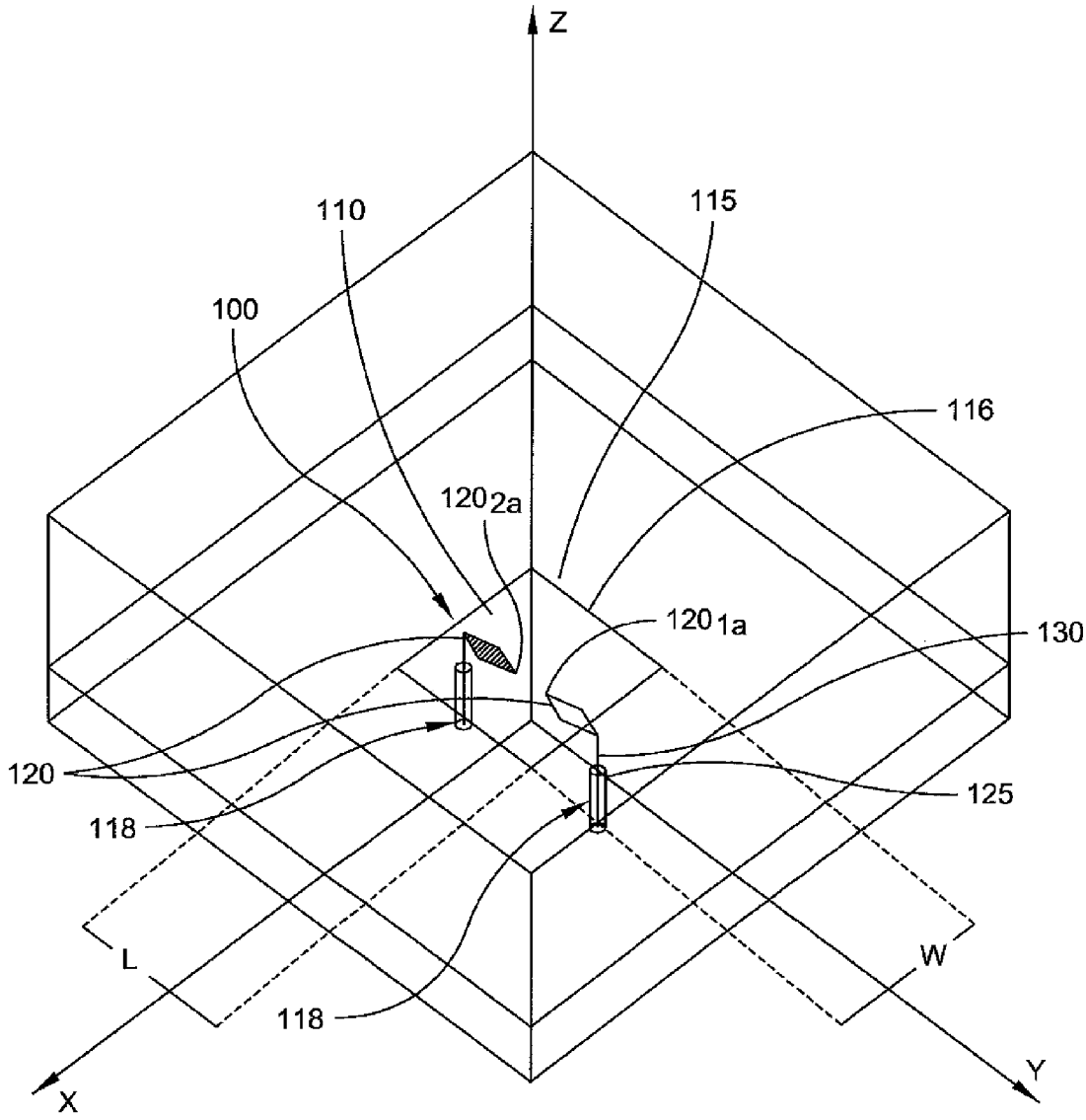
FIG. 1*a* illustrates a diagram of a microstrip rectangular patch and deltoid strip according to an embodiment of the invention.
Figure 2:
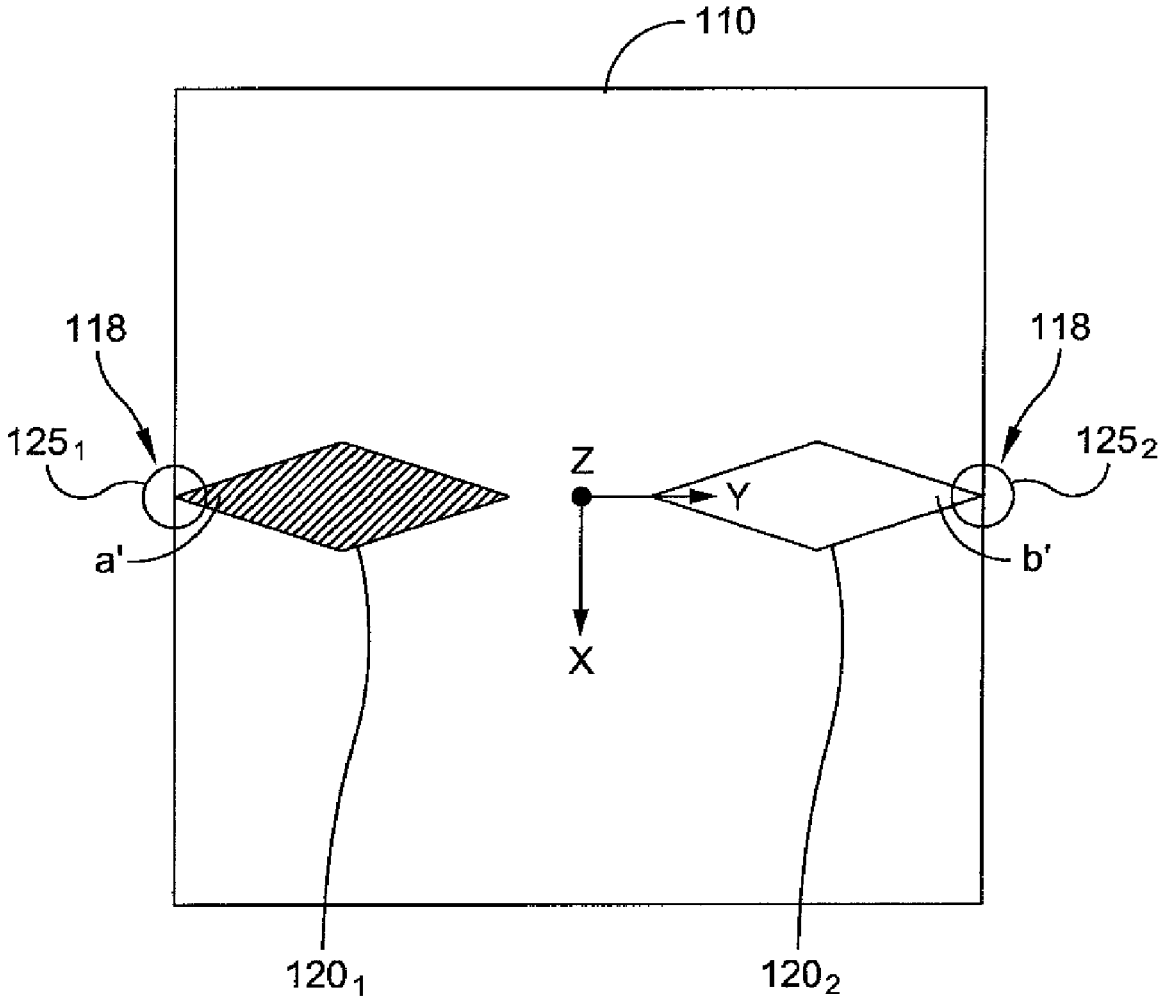
FIG. 2 illustrates a diagram of a deltoid strip according to an embodiment of the invention.

As shown in FIG. 1*a*, one embodiment of the invention relates to a microstrip patch antenna 100 that includes a patch antenna element comprising a conductive layer 110 and a pair of dual probe feeds 118 separate from one another and spaced from and field coupled to patch antenna element conductive layer 110 for transmitting or receiving RF signals. Each of the probe feeds 118 includes a vertically extending conductor segment 125 and a deltoid shaped conductive strip 120 orthogonal to the conductor segment 125. The deltoid shaped conductive strips (labeled generally as 120) are coplanar. A first dielectric layer 115 separates antenna element conductive layer 110 and the coplanar deltoid shaped conductive strips 120. As shown, each of the deltoid shaped conductive strips have their major surfaces extending toward one another such that respective end vertices $\mathbf{120}_{1a}$ and $\mathbf{120}_{2a}$ provide a minimal separation distance while being axially aligned with one another as best shown in FIG. 2. The shape and arrangement of deltoid shaped conductive strips 120 serve to reduce the effects of mutual coupling between the pair of opposing strips and increase the effects of fringing fields.

As shown in FIG. 1*a* patch antenna 100 utilizes a conductive layer 110 having the dimensions along the x-y axis of one quarter of the wavelength (i.e. ¼ λ) of the center frequency of operation. Dielectric layer 115 supports conductive layer 110 and is preferably formed of a flexible, low dielectric constant and low loss foam substrate. The probe feeds labeled generally as 118 electrically feed the antenna element conductive layer 110 by means of the capacitively coupled deltoid strips 120. The patch antenna 100 in FIG. 1*a* is configured as a box shaped parallelogram having a rectangular or square planar conductive layer 110 bounded by a length L and a width W. In an alternate embodiment shown in FIG. 1*b*, the patch antenna 100' is generally cylindrical having a circular shaped conductive layer 110', with conductive strips 120' being substantially rectangular, and the first and second dielectric layers have substantially different dielectric constants.

Referring still to FIG. 1*a*, a second dielectric layer 116 is positioned beneath coplanar deltoid conductive strips 120 such that strips 120 are interposed between the second dielectric layer 116 and the first dielectric layer 115. The vertically extending conductor segments 125 of the probe feeds 118 extend through the second dielectric layer 116.

As will be further described below the deltoid strips 120 have an end vertex to which a conductive connector attaches. The conductive connector may be comprised of a simple bent wire radial member 130 in the shape of an inverted "L" or a generally vertical post that attaches to the deltoid strip at one of its outer vertices. The deltoid strip 120 in a preferred embodiment is constructed from a material such as copper, but may be any conductive material, such as tin, silver, gold or platinum. In one embodiment of the invention the conductive connector is generally cylindrical having a radius and a vertical portion that may be adjusted in order to optimize strip 120 series inductance for a given conductive surface area associated with conductive layer 110. In another embodiment of the invention, the proximity of the conductive layer surface relative to the strip 120 may be adjusted to optimize the strip 120 capacitance that is generally electrically in series with the conductive layer surface. By adjusting strips 120 and the conductive connector inductance and capacitance, the reactance of the electrical circuit may be reduced to zero, thus canceling any reactance, thereby; providing for a wideband operation of antenna 100.

Further, it has been found that the antenna 100 bandwidth is improved with dielectric loading. That is, when dielectric layer 116 is interposed between the conductive connector and the strips 120; and, when dielectric layer 115 is interposed between strips 120 and the conductive surface layer 110. In one embodiment, the first and second dielectric layers have substantially different dielectric constants. For example, the first dielectric layer may have a dielectric constant of about 1.09 and the second dielectric layer may have a dielectric constant of about 3. Dielectric constant of the second dielectric layer can further be varied in order to achieve optimum antenna performance.

Figure 1B:
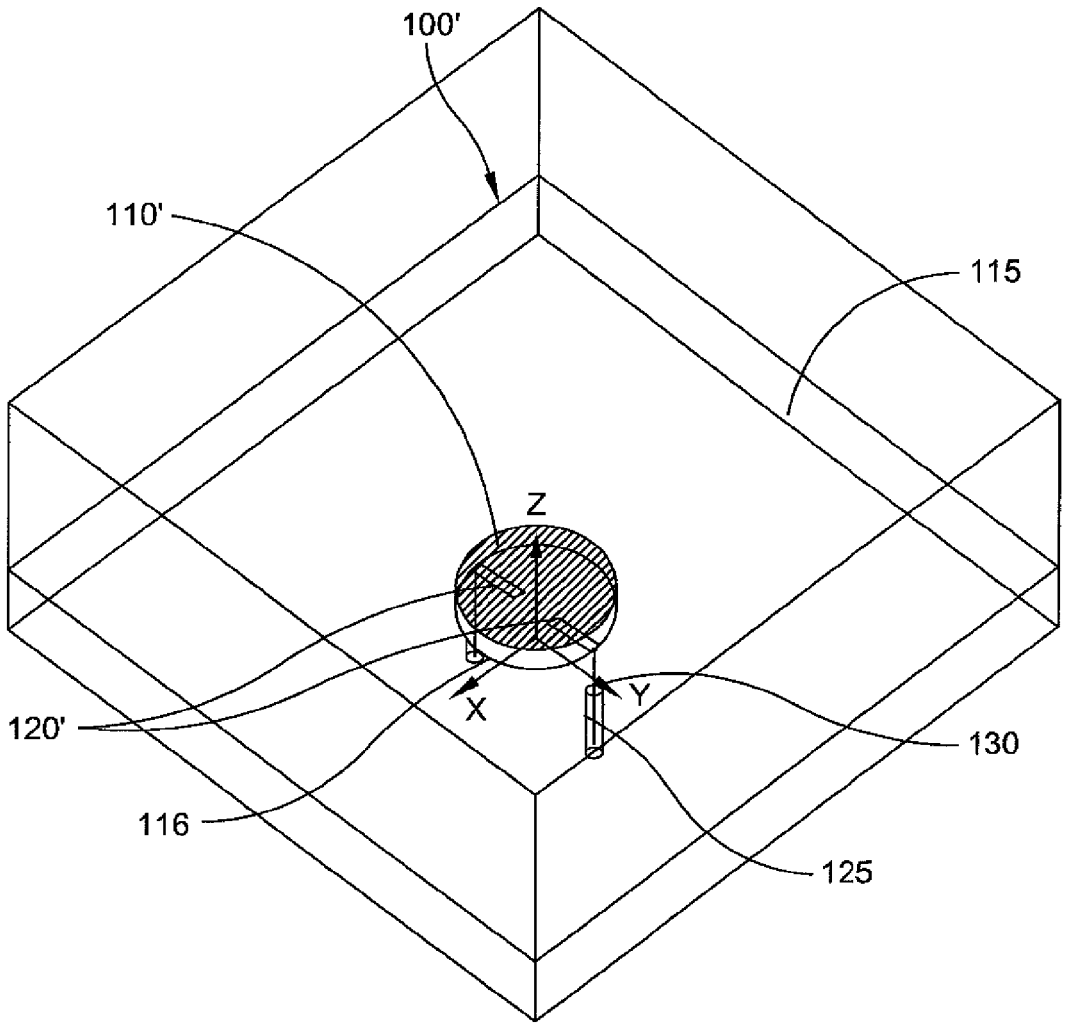
FIG. 1*b* illustrates a diagram of a microstrip circular patch and strip with dielectric loading according to an embodiment of the invention.

FIG. 1*b* is a diagram according to the forgoing principles and represents another embodiment of the present invention. As further shown in FIG. 1*b* the patch antenna 100 is generally cylindrical, having a circular shaped conductive layer 110. Also illustrated in FIG. 1*b* are coplanar strips 120 (designated as $\mathbf{120}_1$ and $\mathbf{120}_2$) each having a deltoid shape.

Figure 1C:
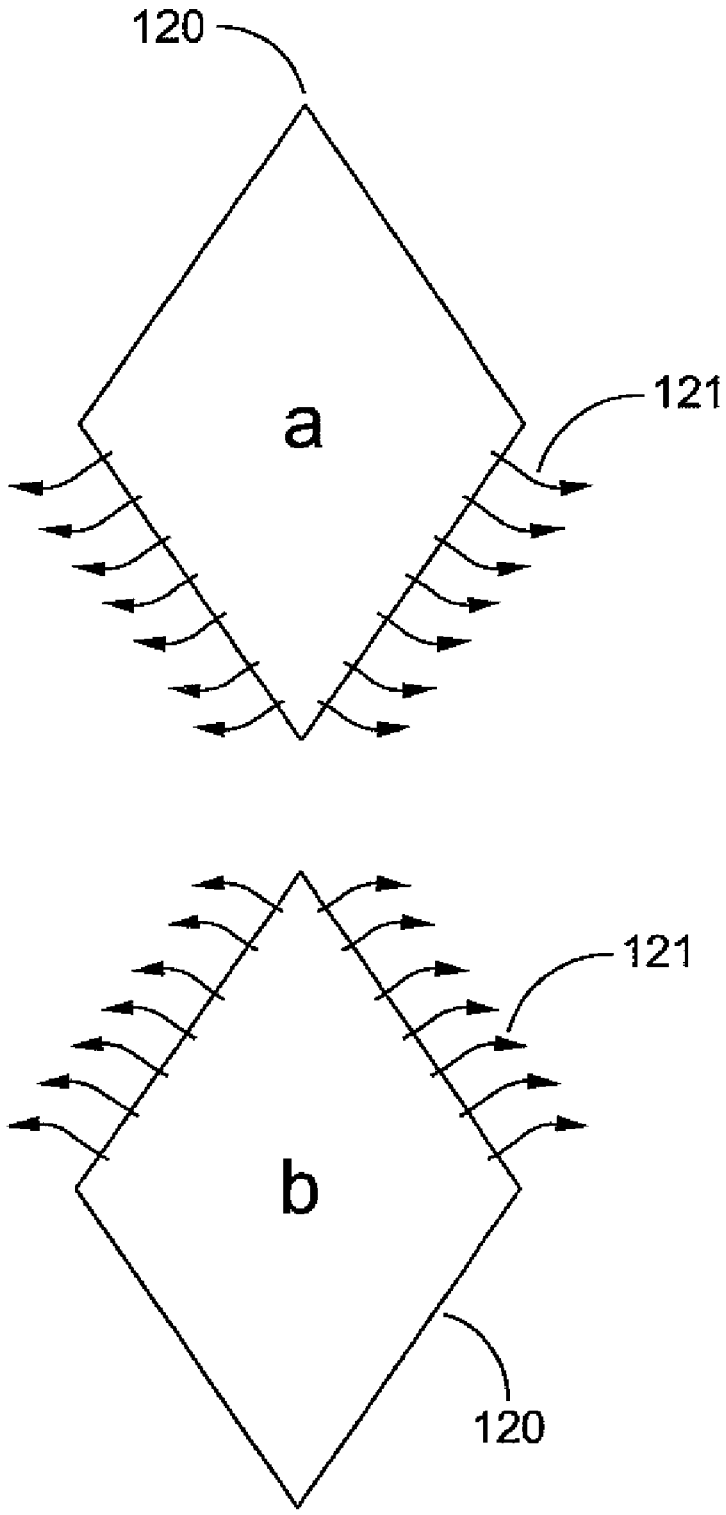
FIG. 1*c* illustrates a diagram of the electric field of a pair of strips according to an embodiment of the invention.

Referring again to FIG. 1*a* the deltoid strips 120 are excited by applying to each strip a voltage signal that is 180 degrees out-of-phase with respect to the other to reduce the cross-polarized radiation imposed across the antenna 100. It has been found that fringing fields emanate from ends of the simple bent wire radial members, such as the inverted "L" previously described. The operational bandwidth of the antenna 100 is increased by directing the simple bent wire radial members, such as the inverted "L" fringing fields, away from each other to reduce coupling. However, an improvement regarding operational bandwidth of the antenna 100 has been achieved by creating strips 120 as coplanar, horizontal members in the shape of deltoids whose end vertices oppose one another. As illustrated in FIG. 1*c*, there is shown a top view of a pair of opposing deltoid strips 120*a*, 120*b*, each having fringing fields 121 and in the shape of a quadrilateral with two disjoint pairs of congruent adjacent sides. The relatively strong opposition of the fringing fields 121 reduces coupling between the two strips 120 and has the effect of increasing the bandwidth of antenna 100.

Referring now to FIG. 2 there is shown a top view of patch antenna 100 described in FIG. 1*a*. The antenna 100 has conductive layer 110 and deltoid strips $\mathbf{120}_1$ and $\mathbf{120}_2$ situated such that the probe feed conductor segment $\mathbf{125}_1$ intersects one outer vertex of the edge of the strip $\mathbf{120}_1$ at point a', while conductor segment $\mathbf{125}_2$ intersects one outer vertex of the edge of the strip $\mathbf{120}_2$ at point b'. The joints at the respective intersections a',b' can be permanently attached through one of soldering or electrostatic bonding.

It has been found that the strip 120 having the deltoid shape and conductor segment 125 provides for operational bandwidths greater than simple bent wire, rectangular, square or radial horizontal members. At least one of the factors that improves bandwidth is that the deltoid horizontal strip 120 provides for greater capacitance variability and hence for wider bandwidth optimization. Computer simulations have been used to determine the improvement of the deltoid strip 120 with dielectric loading. The simulations indicate a 41% increase in bandwidth for square patch antenna 100 using a deltoid strip 120 with dielectric loading such as illustrated in FIG. 1*a* and a 50% increase in bandwidth for cylindrical patch antenna 100 having a circular surface using a deltoid strip 120 with dielectric loading provided by dielectric layers 115, 116.

Figure 3:
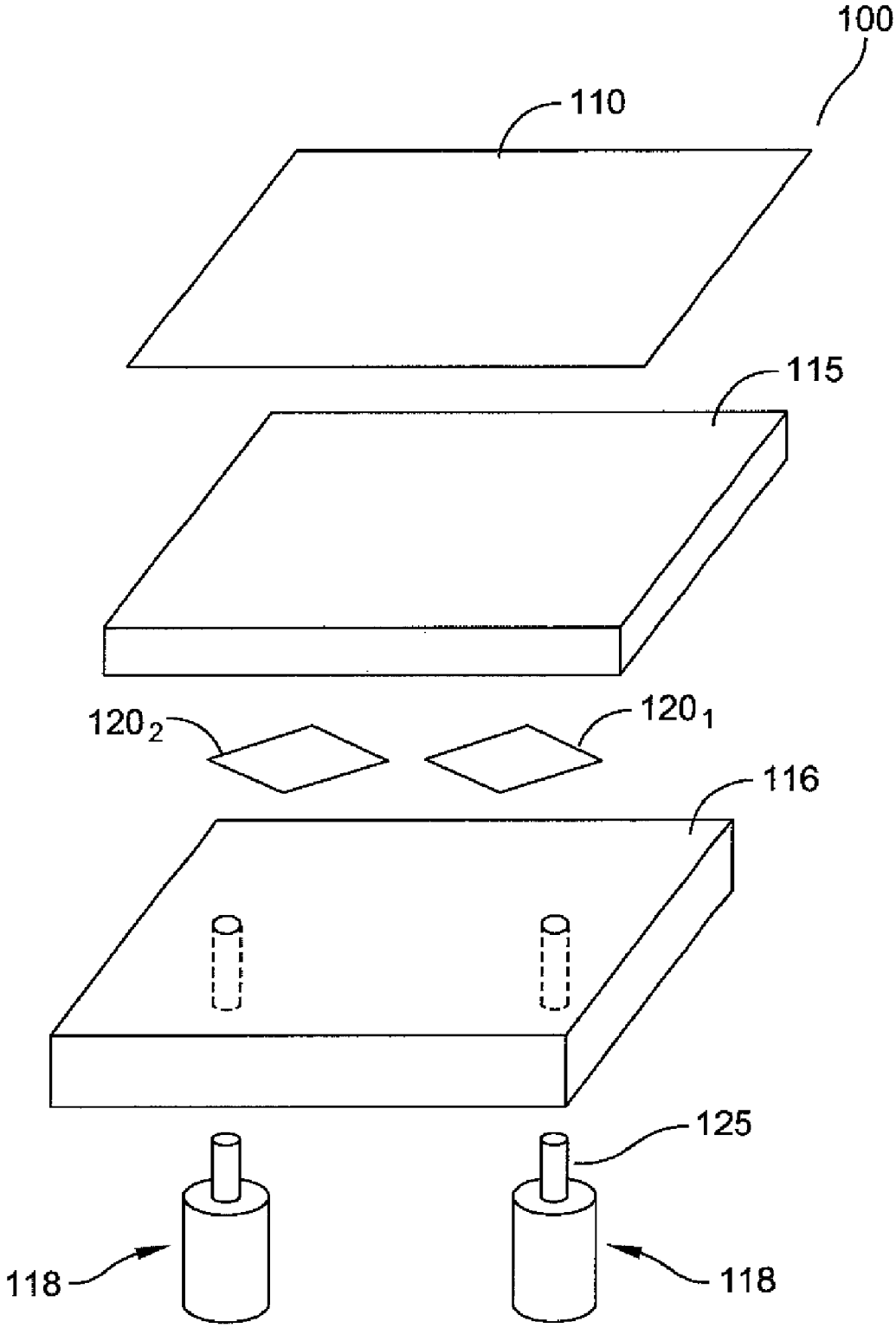
FIG. 3 illustrates an exploded view of a patch and deltoid strip according to an embodiment of the invention.

FIG. 3 illustrates an exploded parts diagram of a patch antenna 100 with deltoid strip 120 according to an embodiment of the invention. A first dielectric layer 115 of a generally foam dielectric material has bonded thereto conductive layer 110, which takes the form of a substantially flat, planar conductive member. Conductive layer 110 may be made from a conductive material such as a copper laminate, for example. The conductive layer 110 functions as a planar radiating element. Deltoid strip 120 is interposed between a second dielectric layer 116 and the first dielectric layer 115. Probe feeds designated generally as 118 and having vertically extending conductor segments 125 extending through second dielectric layer 116 provide the electrical input connection to each coplanar deltoid strip 120. The thickness of the copper laminate 110 and the deltoid strips 120 may be adapted dependent upon the transmission power the antenna 100 is configured to deliver. In an exemplary embodiment, the dielectric layer 115 material is a low dielectric, low weight flexible substrate (e.g. C-foam: $\epsilon r \sim 1.09$, tan $\delta = 0.001$) supplied by Cuming Microwave Corporation Avon, Mass. 02322. One embodiment of the invention utilizes a conductive coating supplied under the trademark Metal Rubber™ a trademark of Nanosonic, Inc. Christiansburg, Va. 24068 and applied to the surfaces of the dielectric layers 115, 116.

Figure 4A:
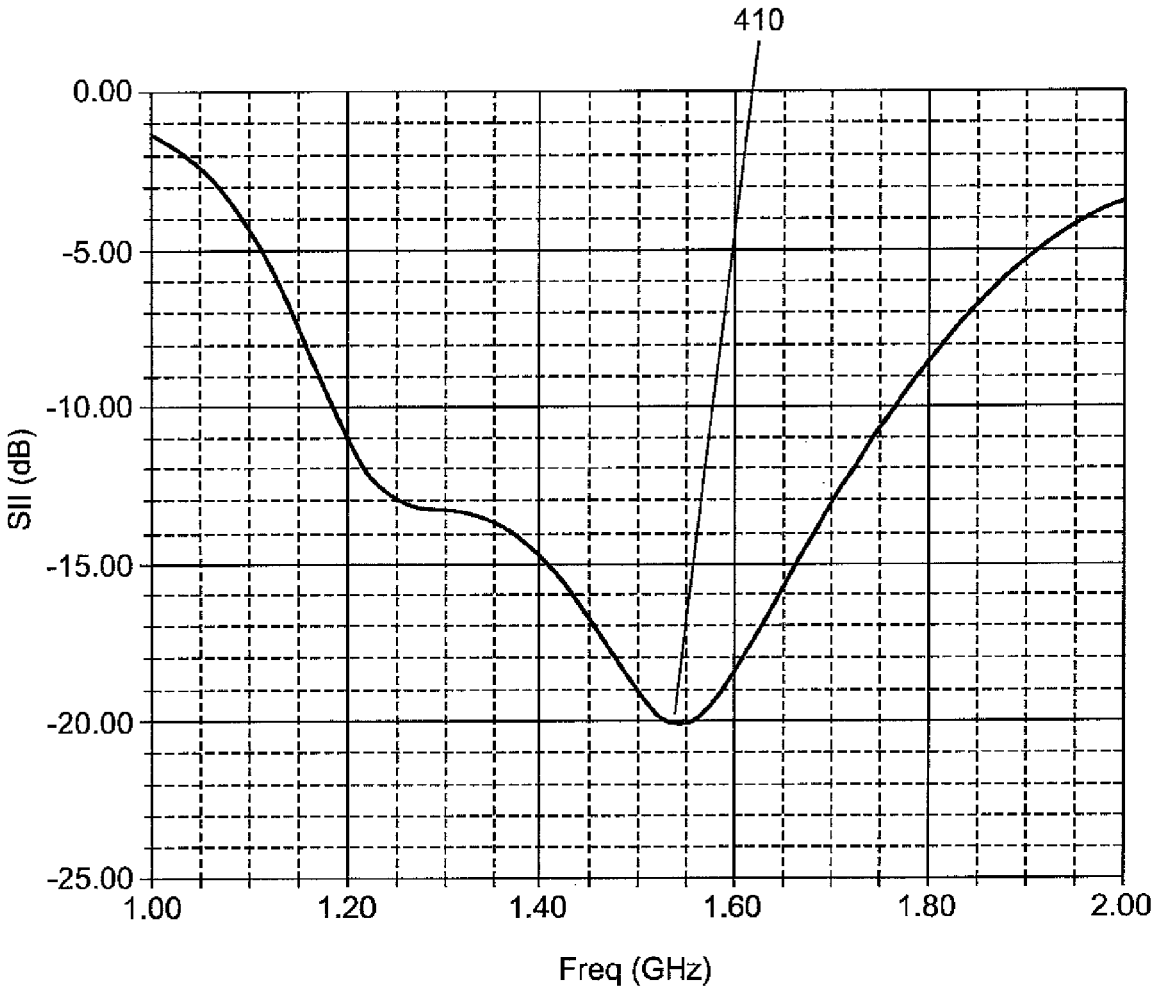
FIG. 4*a* illustrates a graph of a microstrip rectangular patch and deltoid strip frequency response according to an embodiment of the invention.

FIG. 4*a* illustrates a graph of a microstrip rectangular patch and deltoid strip frequency response according to an embodiment of the invention. A frequency is plotted against a relative frequency indicating an approximate bandwidth of 40% with a center frequency 410. The fractional bandwidth is defined as: $((F_{high}-F_{low})/F_{center})\times 100\%$. It was found that a non deltoid configured patch typically performs in the range of 3% to 7% bandwidth. A VSWR of 2:1 is approximately equivalent to return loss of 10 dB, or 90% of power being delivered to the antenna.

Figure 4B:
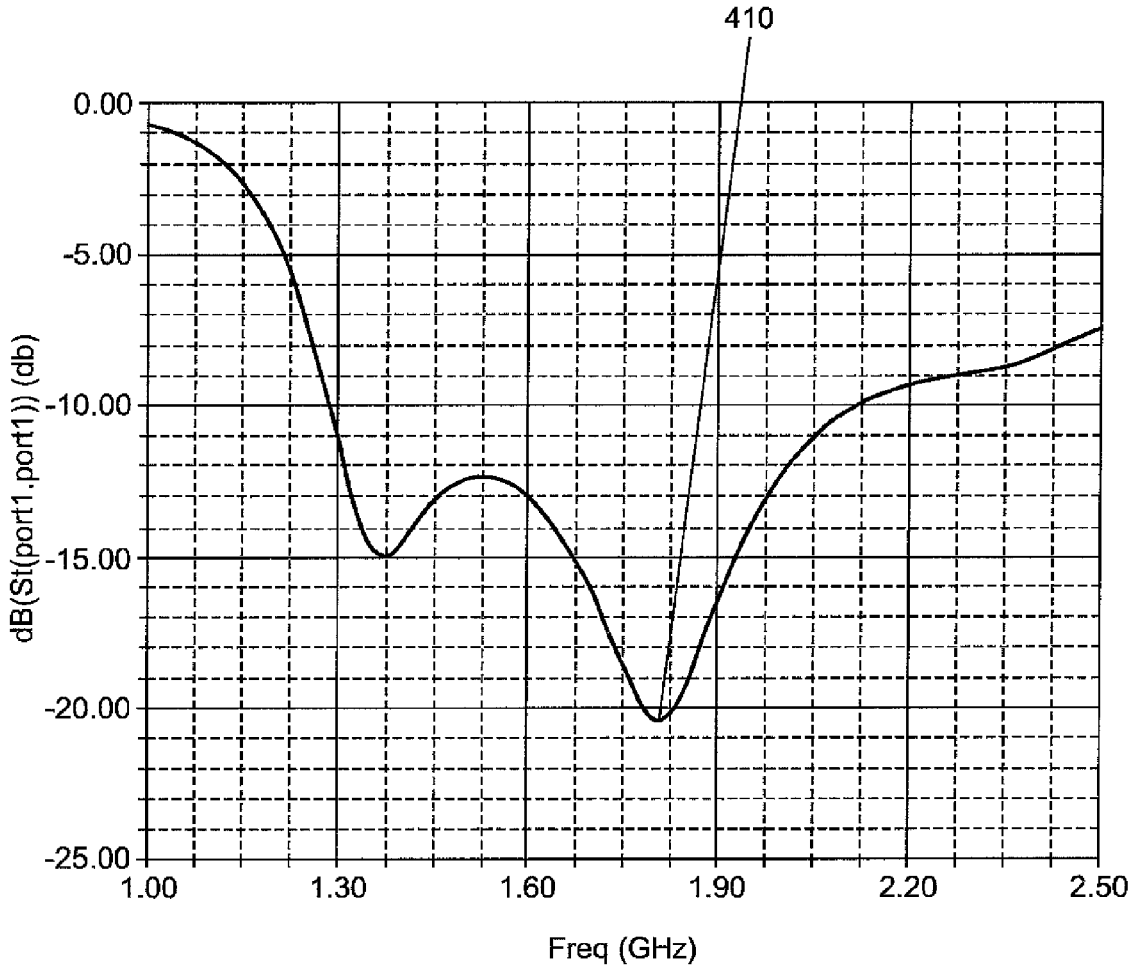
FIG. 4*b* illustrates a graph of a microstrip circular patch and deltoid strip frequency response according to an embodiment of the invention.

FIG. 4*b* illustrates a graph of a microstrip cylindrical patch and a deltoid strip frequency response according to an embodiment of the invention. A frequency is plotted against a relative frequency indicating an approximate bandwidth of 50%.

Figure 4C:
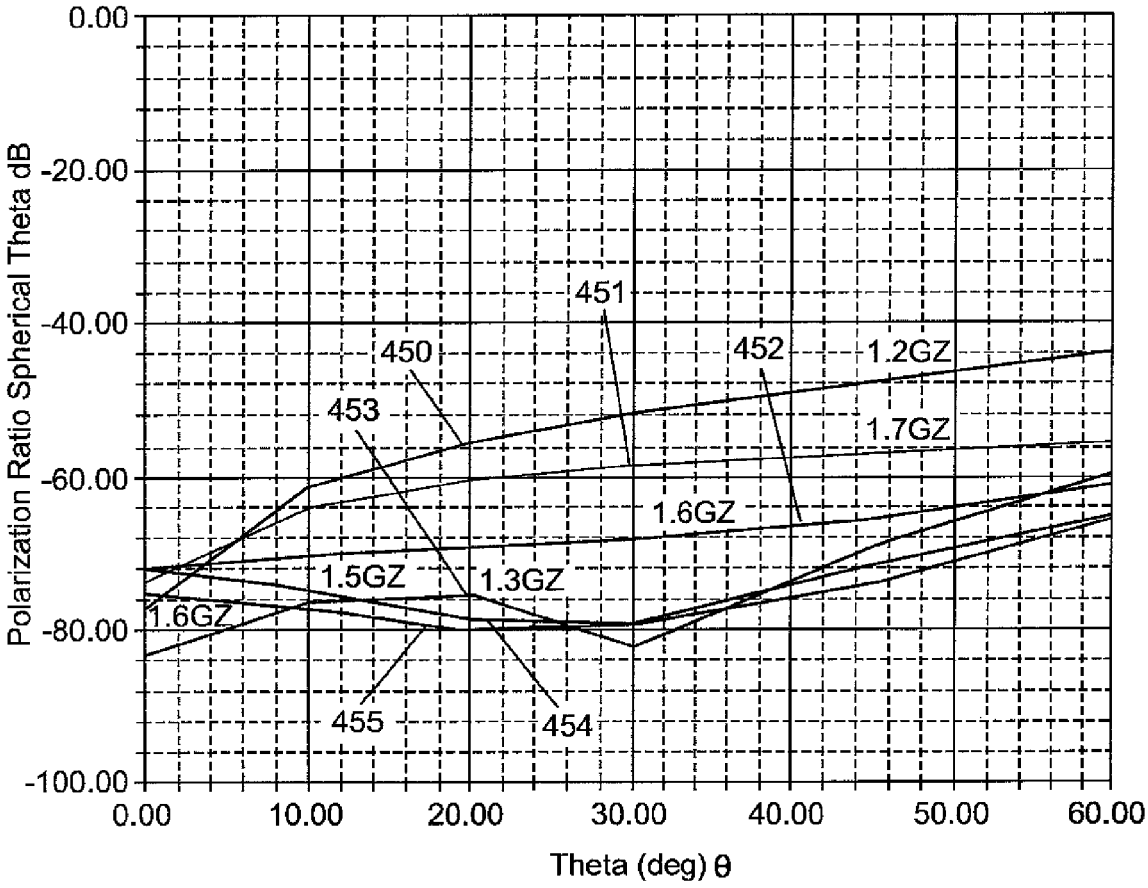
FIG. 4*c* illustrates a graph of a microstrip circular patch polarization response according to an embodiment of the invention.
Figure 4D:
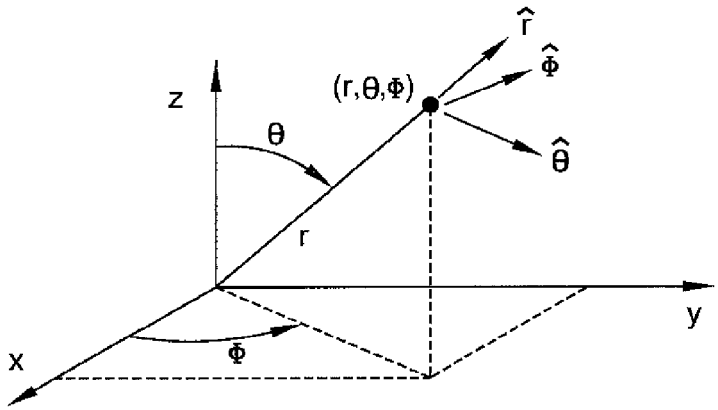
FIG. 4*d* illustrates a three dimensional coordinate system for reference to a microstrip circular patch polarization response in FIG. 4*c* according to an embodiment of the invention.

FIG. 4*c* illustrates a graph of a microstrip circular patch and deltoid strip polarization response according to an embodiment of the invention. With reference to FIG. 1*a*, FIG. 4*d* and the graph FIG. 4*c* the plots represents the cross polarization ratio of the spherical angle as plotted against the transmission angle. The Institute of Electrical and Electronics Engineers (IEEE) defines the (complex) polarization ratio as: "For a given field vector at a point in space, the (magnitude of the) ratio of the complex amplitudes of two specified orthogonally polarized field vectors into which the given field vector has been resolved (see, IEEE Standard Definitions of Terms for Antennas, IEEE Transactions on Antennas and Propagation, vol. AP-31 num. 6, November 1983).

Antenna elements as shown in FIG. 1*c* are excited at various frequencies (e.g., 1.2 GZ, 450; 1.7 GZ, 451; 1.6 GZ 452; 1.3 GZ, 453; 1.5 GZ, 454; and 1.6 GZ, 455) and the electric field is measure measured at various angles theta in the X-Z plane shown both in FIG. 1*a* and FIG. 4*d* in terms of a radiation E in the direction X (e.g., elevation), versus the radiation H in the direction Y (e.g., azimuth).

Within the constructs of the IEEE definition the polarization ratio of the spherical angle as plotted against the transmission angle indicates −40 dB over full scan. It was found that a non deltoid, single feed configured patch this ratio is typically as high as −3 dB for some angles.

Figure 5:
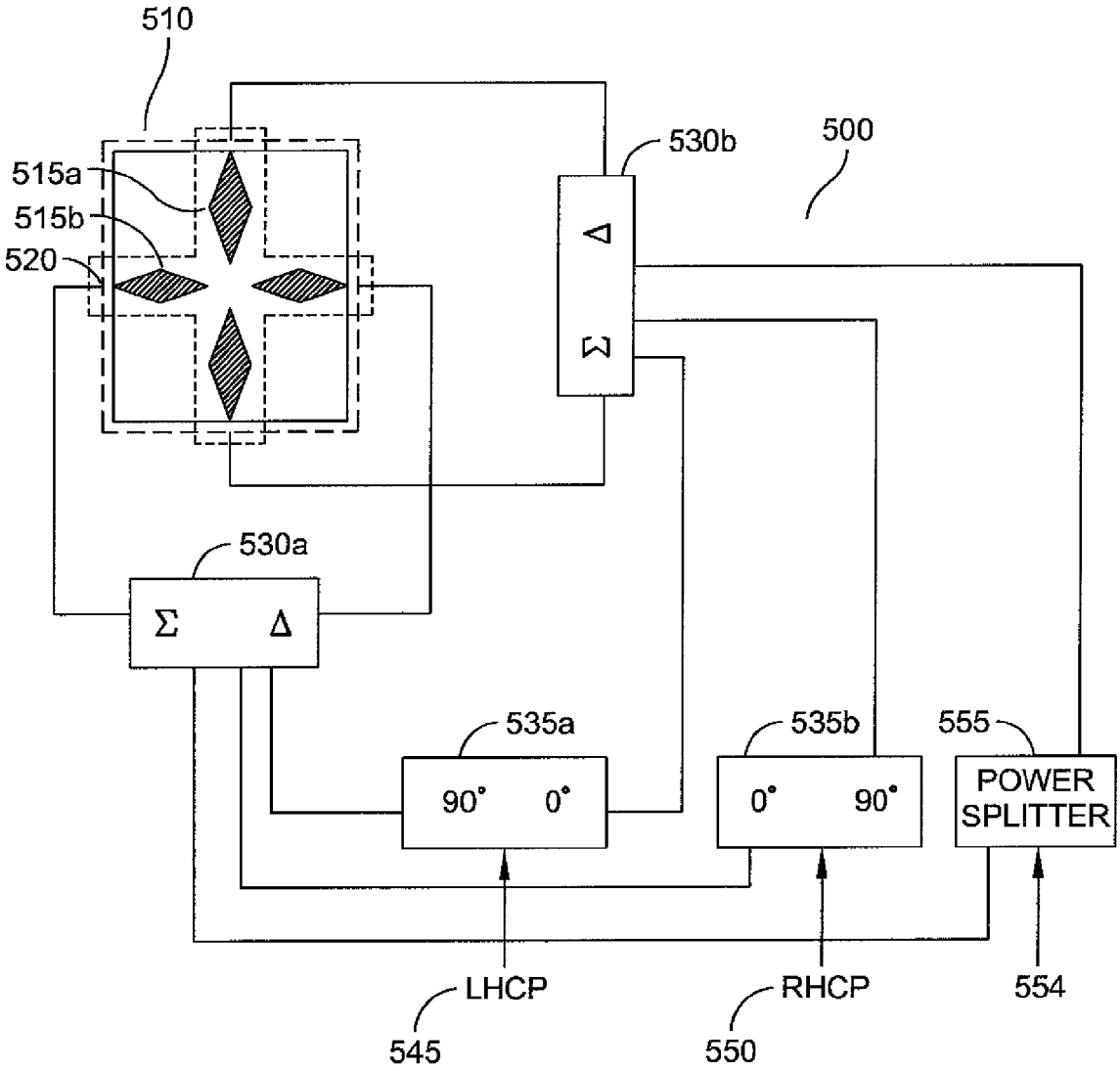
FIG. 5 illustrates a schematic of a microstrip patch and deltoid strip utilized in a phase array transmission and reception system according to an embodiment of the invention.

FIG. 5 illustrates a block diagram of an antenna 510 in the form of a microstrip patch with two pairs of deltoid strips 515*a*, 515*b*, each pair configured orthogonal to the other according to an embodiment of the invention. This configuration can be used in a phased array transmission and reception (bi directional) application according to another embodiment of the invention. With reference to FIG. 3 the dielectric member 115, electrically attaches on the distal side to the planar radiating element 110 and on the proximal side to a pair of deltoid strips 515, FIG. 5.

In one embodiment of the invention, the patch antenna 510 is used in association with an array of patch antennas that further includes a plurality of associated transmit-receive modules, panel manifolds that feed and receive signals from the transmit-receive modules wave form generators, up conversion processors that feed the panel manifolds, and a plurality of receiver and digital demodulators that receive signals from the panel manifolds.

Referring to FIG. 5, except for lines designated with an arrow head, all lines represent bidirectional signal flow. A first 180° splitter/combiner 530*a* and a second 180° splitter/combiner 530*b* are each coupled to a respective deltoid strip 515. The first 180° splitter/combiner 530*a* is approximately 180° out of phase with the second feed 530*b* as is common for a phased array antenna. A 90° splitter/combiner 535*a* and a 90° splitter/combiner 535*b* provide quadrature signals, each driven respectively by control signals 545 and 550, to each of the first feed 530*a* and second feed 530*b*, respectively. A switch with splitter combiner 555 is fed from a single/dual linear signal is used for both transmission and reception of an antenna signal. The switch with splitter combiner 555 circuit is able to switch to either linear polarization, one at the time or combiner/split both for dual linear polarization.

Figure 6A:
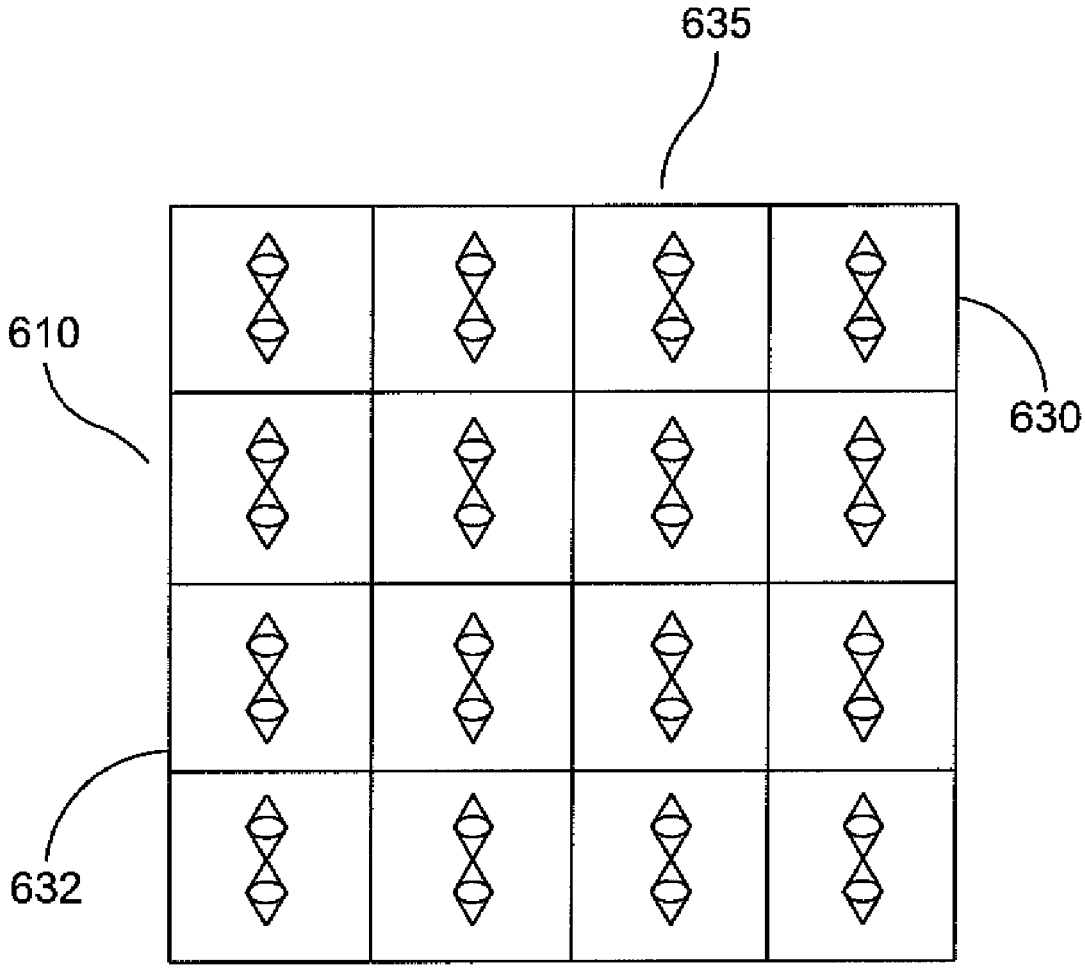
FIG. 6*a* illustrates a portion of a flexible microstrip patch array with each patch having a deltoid strip according to an embodiment of the invention.
Figure 6B:
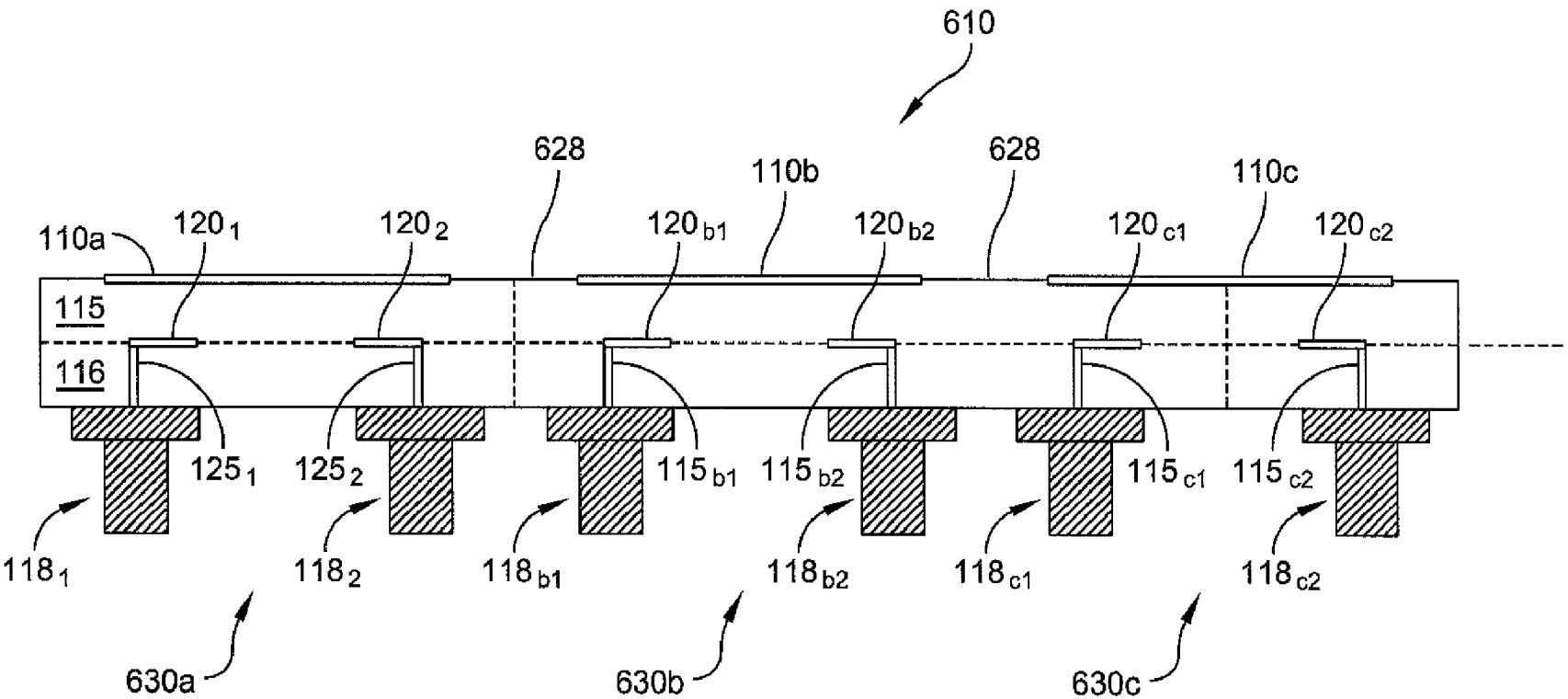
FIG. 6*b* illustrates a top view of a flexible microstrip patch array according to an embodiment of the invention.

FIG. 6*a* illustrates a front view of a microstrip patch antenna array 610 comprised of a number of antenna elements 630, each as illustrated in FIG. 1*a* arranged in rows 632 and/or columns 635. FIG. 6*b* illustrates a side view of a portion of the array 610. Patch antenna elements 630*a*, 630*b* and 630*c* are representative of three patch antennas arranged in a row such as row 632. Each patch antenna 630*a*, 630*b*, 630*c* has the structure and configuration shown in FIG. 3. By way of example, for patch antenna element 630*a*, a conductive surface layer 110*a* (FIG. 3, 110) overlays a dielectric foam layer 115 (FIG. 3). A second dielectric layer 116 (FIG. 3) supports the deltoid strips $\mathbf{120}_1$, $\mathbf{120}_2$ (FIG. 3). A gutter 628 separates each patch antenna 630*a*, 630*b*. Probe feed connectors $\mathbf{118}_1$, $\mathbf{118}_2$ provide for the electrical connection to coplanar deltoid strips $\mathbf{120}_1$, $\mathbf{120}_2$ via corresponding vertically extending conductor segments $\mathbf{125}_1$ and $\mathbf{125}_2$. Each of the corresponding antenna elements 630*b*, 630*c* are configured in like manner with element designations "b" and "c", respectively.

The microstrip patch antenna array elements 630 are in one application affixed in adjacent parallel rows to a surface to emit and receive electromagnetic signals in forming multiple electromagnetic beams. In one embodiment, each of the antenna elements is adapted to operate as a corresponding autonomous electronically scanned radar, wherein each radar is capable of independently forming, steering, and shaping transmit and receive beams.

Figure 7:
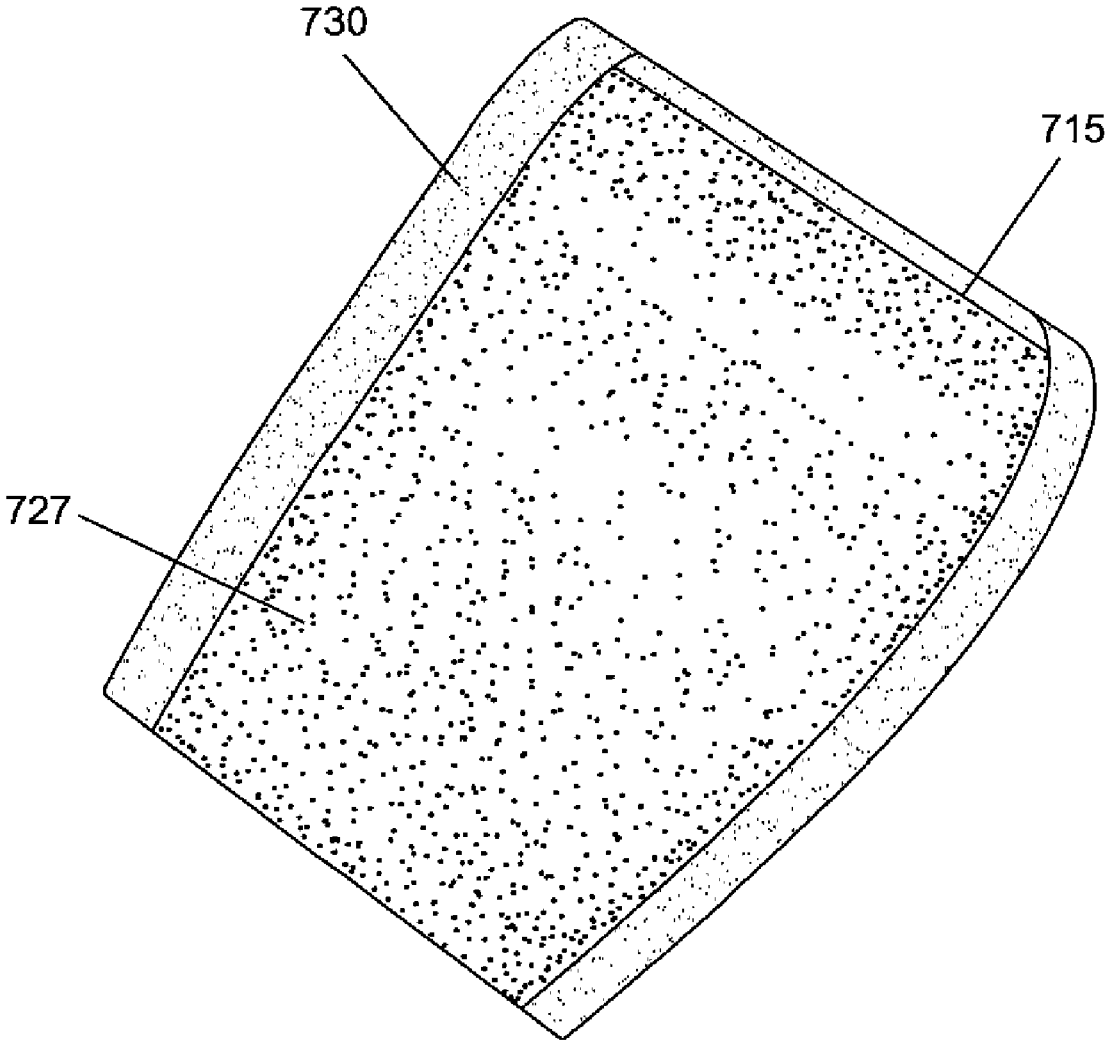
FIG. 7 illustrates a perspective view of a flexible microstrip patch coiled for use according to an embodiment of the invention.

FIG. 7 illustrates a perspective view of a flexible microstrip patch coiled for subsequent use according to an embodiment of the invention. The coil comprises a roll of microstrip patch antenna array 715 such as illustrated in FIG. 6*a*, 610 having a number of antenna elements arranged in rows 630 and/or columns 635. By way of example a conductive surface 727 overlays a dielectric foam layer 730 that supports the element (FIG. 3, 116) upon which are installed the deltoid strips (FIG. 3, 120). A gutter (not shown) separates each patch antenna of the array 715. The first conductive layer, first dielectric layer, and second dielectric layer are thus formed of a flexible material and in one embodiment the first and second dielectric layers have substantially different dielectric constants.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A microstrip patch antenna comprising:

a patch antenna element comprising a first conductive layer;

dual probe feeds separate from each other and spaced from and field coupled to said patch antenna element for transmitting or receiving RF signals, each of said dual probe feeds having a conductor segment and a deltoid shaped conductive strip orthogonal to said conductor segment, said deltoid shaped conductive strips being coplanar and separate from one another; and a first dielectric material layer separating said first conductive layer and said coplanar deltoid shaped conductive strips;

wherein each of said deltoid shaped conductive strips comprises a pair of opposing vertices, defining a first vertex coupled to said dual probe feed and a second vertex opposite said first vertex, the second vertex of a first deltoid shaped conductive strip positioned adjacent to the second vertex of a second deltoid conductive strip of said pair.

2. The microstrip patch antenna of claim 1, wherein the pair of probe feeds apply RF signals that are approximately 180 degrees out of phase with respect to one another.

3. The microstrip patch antenna of claim 1, further comprising a second pair of said dual probe feeds electrically separate from each other and spaced from and field coupled to said patch antenna element for transmitting or receiving RF signals, each of said second pair of dual probe feeds having a conductor segment and a deltoid shaped conductive strip orthogonal to said conductor segment; said deltoid shaped conductive strips being coplanar and separate from one another, wherein said first and second pairs of deltoid shaped conductive strips are arranged orthogonal to one another and wherein each of said deltoid shaped conductive strips of said second pair of dual probe feeds comprises a pair of opposing vertices, defining a first vertex coupled to said dual probe feed and a second vertex opposite said first vertex, the second vertex of a first deltoid shaped conductive strip positioned adjacent to the second vertex of a second deltoid conductive strip of said pair.

4. The microstrip patch antenna of claim 3, wherein first and second splitter/combiner modules provide quadrature signals to said pairs of probe feeds.

5. The microstrip patch antenna of claim 4, further comprising a switch for switching to one of a linear polarization mode and a dual polarization mode.

6. The microstrip patch antenna of claim 1, wherein said first conductive layer and first dielectric layer are formed of flexible materials and have a rectangular configuration.

7. The microstrip patch antenna of claim 1, wherein said first conductive layer and first dielectric layer are formed of flexible materials and have a cylindrical configuration.

8. The microstrip patch antenna of claim 1, further comprising a second dielectric layer beneath said coplanar deltoid shaped conductive strips and through which said conductor segments extend.

9. The microstrip patch antenna of claim 8, wherein the first conductive layer, first dielectric layer, and second dielectric layer are formed of a flexible material and wherein the first and second dielectric layers have substantially different dielectric constants.

10. The microstrip patch antenna of claim 9, wherein said first dielectric layer has a dielectric constant of approximately 1.09 and second dielectric layer has a dielectric constant of approximately 3.

11. The microstrip patch antenna of claim 1, wherein said first dielectric layer has a dielectric constant of approximately 1.09.

12. The microstrip patch antenna of claim 1, further including a plurality of said antenna elements affixed in adjacent parallel rows to emit and receive electromagnetic radiation, each of said plurality of antenna elements being adapted to operate as a corresponding electronically scanned radar.

13. The microstrip patch antenna of claim 12, wherein each of the plurality of antenna elements is capable of independently forming, steering, and shaping transmit and receive beams.

14. A patch antenna comprising:

a first dielectric layer having a top surface on which is disposed a planar conductive member affixed to the top surface;

at least one pair of coplanar conductive strips in the form of deltoid segments separate from one another and interposed between the first dielectric layer and a second dielectric layer; wherein each said strip is electrically coupled to a corresponding connector that provides an RF signal wherein each of said deltoid segment comprises a pair of opposing vertices, defining a first vertex coupled to said corresponding connector and a second vertex opposite said first vertex, the second vertex of a first deltoid segment positioned adjacent to the second vertex of a second deltoid segment of said pair.

15. The patch antenna of claim 14, wherein the patch antenna comprises a plurality of antenna elements arranged in columns.

16. The patch antenna of claim 14, wherein the patch antenna comprises a plurality of antenna elements arranged in an array of rows and columns.

17. The patch antenna of claim 14, wherein the first and second dielectric layers have substantially different dielectric constants.

18. The patch antenna of claim 14, wherein the first and second dielectric layers and the planar conductive member are formed of flexible materials.

19. The patch antenna of claim 14, wherein each said strip receives the RF signal approximately 180 degrees out of phase with respect to one another.

20. The patch antenna of claim 14, wherein said deltoid shaped conductive strips have their major surfaces extending toward one another such that respective end vertices provide a given separation distance there between and operate to reduce the effects of mutual coupling between the pair of opposing strips and increase the effects of fringing fields.

21. A microstrip patch antenna comprising:

a patch antenna element comprising a first conductive layer;

dual probe feeds separate from each other and spaced from and field coupled to said patch antenna element for transmitting or receiving RF signals, each of said dual probe feeds having a conductor segment and a deltoid shaped conductive strip orthogonal to said conductor segment, said deltoid shaped conductive strips being coplanar and each deltoid strip having a first vertex and a second vertex opposing the first vertex, the first vertex electrically coupled to a corresponding probe feed, and the second vertex of a first deltoid strip positioned proximal to the second vertex of a second deltoid strip without contacting the second deltoid strip, wherein the first and second vertices of the first deltoid strip are collinear with the first and second vertices of the second deltoid strip; and a first dielectric material layer separating said first conductive layer and said coplanar deltoid shaped conductive strips.

22. The microstrip patch antenna of claim 21, wherein the pair of probe feeds apply RF signals that are approximately 180 degrees out of phase with respect to one another.

23. The microstrip patch antenna of claim 21, further comprising a second pair of said dual probe feeds separate from each other and spaced from and field coupled to said patch antenna element for transmitting or receiving RF signals, each of said second pair of dual probe feeds having a conductor segment and a deltoid shaped conductive strip orthogonal to said conductor segment; said deltoid shaped conductive strips being coplanar and each deltoid strip associated with the second pair of dual probe feeds having a first vertex and a second vertex opposing the first vertex, the first vertex electrically coupled to a corresponding probe feed, and the second vertex of a third deltoid strip positioned proximal to the second vertex of a fourth deltoid strip without contacting the fourth deltoid strip, wherein the first and second vertices of the third deltoid strip are collinear with the first and second vertices of the fourth deltoid strip, and wherein said first and second pairs of deltoid shaped conductive strips are arranged orthogonal to one another.

24. The microstrip patch antenna of claim 21, further comprising a second dielectric layer beneath said coplanar deltoid shaped conductive strips and through which said conductor segments extend.

25. The microstrip patch antenna of claim 24, wherein the first conductive layer, first dielectric layer, and second dielectric layer are formed of a flexible material and wherein the first and second dielectric layers have substantially different dielectric constants.

26. A patch antenna comprising:

a first dielectric layer having a top surface on which is disposed a planar conductive member affixed to the top surface;

at least one pair of coplanar conductive strips in the form of deltoid segments separate from one another and interposed between the first dielectric layer and a second dielectric layer; wherein each said strip is electrically coupled to a corresponding connector that provides an RF signal and wherein each deltoid strip has a first vertex and a second vertex opposing the first vertex, the first vertex electrically coupled to the corresponding connector, and the second vertex of a first deltoid strip positioned proximal to the second vertex of a second deltoid strip without contacting the second deltoid strip, and the first and second vertices of the first deltoid strip are collinear with the first and second vertices of the second deltoid strip.

27. The patch antenna of claim 26, wherein the first and second dielectric layers and the planar conductive member are formed of flexible materials.

28. The patch antenna of claim 26, wherein each said strip receives the RF signal approximately 180 degrees out of phase with respect to one another.

29. The patch antenna of claim 26, wherein said deltoid shaped conductive strips have their major surfaces extending toward one another such that respective end vertices provide a given separation distance there between and operate to reduce the effects of mutual coupling between the pair of opposing strips and increase the effects of fringing fields.

* * * * *